US005126749A

United States Patent [19]

Kaltner

[11] Patent Number: 5,126,749

[45] Date of Patent: Jun. 30, 1992

[54] INDIVIDUALLY FED MULTILOOP ANTENNAS FOR ELECTRONIC SECURITY SYSTEMS

[76] Inventor: George W. Kaltner, 1008 Industrial Dr., Unit H, Berlin, N.J. 08009

[21] Appl. No.: 398,629

[22] Filed: Aug. 25, 1989

[51] Int. Cl.[5] ..... H01Q 7/04; G08B 13/22

[52] U.S. Cl. ..... 343/742; 343/867; 340/572

[58] Field of Search ..... 343/741, 742, 867, 853; 340/572

[56] References Cited

U.S. PATENT DOCUMENTS 4,243,980 1/1981 Lichtblau ..... 343/742

4,633,250 12/1986 Anderson et al. ..... 343/742

4,845,509 7/1989 Asbrink ..... 343/867

4,872,018 10/1989 Feltz et al. ..... 343/742

FOREIGN PATENT DOCUMENTS 510172 2/1955 Canada ..... 343/867

*Primary Examiner*—Michael C. Wimer

*Attorney, Agent, or Firm*—Norman E. Lehrer

[57] ABSTRACT

An antenna system for use in an electronic security system transmitter or receiver having two or more loops. Each loop of the transmitter or receiver antenna system being individually connected to a splitter network in the transmitter and a combiner network in the receiver.

5 Claims, 3 Drawing Sheets

INDIVIDUALLY FED MULTILOOP ANTENNAS FOR ELECTRONIC SECURITY SYSTEMS

BACKGROUND OF THE INVENTION

The present invention is directed toward an antenna system for use in an electronic security system and, more particularly, toward such an antenna system which includes individually fed multiple loops.

Electronic security anti-pilferage systems are widely known for the detection of the unauthorized removal of items tagged by a detectable target containing a resonant circuit, saturable magnetic wire strip or mechanically resonant magnetic material. The basic concepts for such theft detection systems are described in U.S. Pat. Nos. 3,810,147; 3,973,263; 4,016,553; 4,215,342 and 4,795,995 and many others.

A variety of antenna configurations have been designed to be used with anti-pilferage systems. Practical transmitter antenna designs typically have one or more loops of wire carrying alternating current to generate an electromagnetic field. The receiver antenna is also typically one or more loops of wire which receives small distortions or disturbances in the electromagnetic field caused by the detectable target as it passes through the interrogation zone between the transmitter and receiver antennas. A desirable feature of the receiver antenna system is for it to be sensitive to signals originating within the interrogation zone or at distances which are small relative to the antenna dimensions and be insensitive to or cancel noise and spurious signals which originate at distances far from the interrogation zone, i.e. at distances that are large compared to the antenna dimensions.

Similarly, it is desirable for the transmitter antenna to create a strong local field in the interrogation zone and minimize or cancel fields created at large distances from the interrogation zone. Such transmitter antenna far field cancellation is beneficial in meeting RF emission levels as may be required by the FCC or other similar regulatory agencies.

Far field cancellation is demonstrated by Heltemes in U.S. Pat. No. 4,135,183 with an hourglass or figure eight design receiver and transmitter antenna. Lichtblau in U.S. Pat. No. 4,243,980 proposes twisting a single conductor to form a multiloop far field cancelling design. In U.S. Pat. No. 4,251,808, a conductive shield is added enclosing the twisted loops to provide electrostatic shielding. And in U.S. Pat. No. 4,751,516, Lichtblau proposes driving symmetrical half sections of twisted loops.

All of the far field cancelling multiple loop antennas in the above-cited patents inherently suffer from an inability to achieve good amplitude balance and exact phase opposition at high frequencies. Twisted loops inherently shift current phase relative to the driving source as one moves away from the source causing unbalance in the loops furthest from the source. Shielded loops exaggerate the problem. Additionally, the above-mentioned inherent phase unbalance can, in some frequency-swept detection systems, cause undesirable effects which manifest as distortions to the signals normally associated with the field disturbance targets or markers.

SUMMARY OF THE INVENTION

The present invention is designed to overcome the deficiencies of the prior art described above. The antenna system of the present invention which is useful in an electronic security system transmitter or receiver has two or more loops. Each loop of the transmitter antenna system is individually connected to a splitter network in the transmitter while each loop of the receiver antenna system is individually connected to a combiner network in the receiver.

By individually connecting each of the loops, each loop can be controlled independently of the others. As a result, minimum phase shift occurs in loops far from the driving source thereby achieving more exact phase and amplitude balance. In addition, this individually driven arrangement can extend the useful frequency range of a given antenna geometry by using a larger number of individually driven smaller loops. In addition, detection patterns can be more readily optimized because of the independent and infinite adjustability of the current and area in each loop. Flatter frequency response and better matched linear phase characteristics in each loop can also be achieved which minimize undesirable distortions in received marker signals. The improved arrangement also allows for the independent signal processing of each receiving loop, independent pulsing or time multiplexing of the transmitter loops to achieve improved immunity to false alarms or improved detection coverage.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
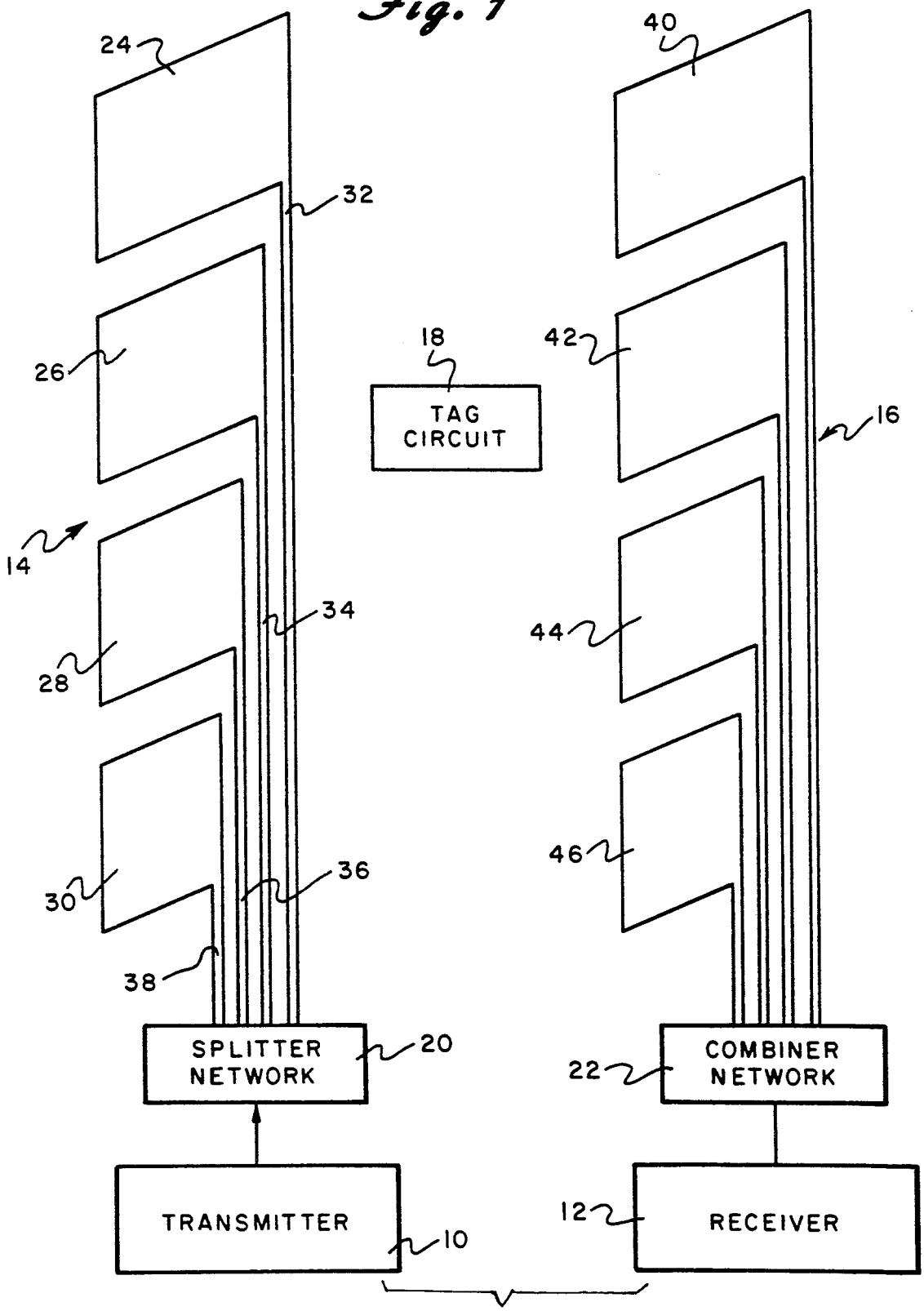
FIG. 1 is a schematic representation of a electronic security system illustrating the antenna system of the present invention.

Referring now to the drawings in detail wherein like reference numerals have been used throughout the various figures to designate like elements, there is shown in FIG. 1 an electronic security system utilizing the improved antenna system of the present invention. The security system includes a transmitter 10 and a receiver 12 which are connected to a transmitting antenna system 14 and a receiving antenna system 16, respectively. The antenna systems 14 and 16 are disposed in spaced parallel relationship with respect to each other so that the security system can sense the presence of a resonant tag circuit 18 (or other marker tag such as a magnetic marker or other target circuit) which can pass through the space between the antennas 14 and 16.

The actual arrangement of the antennas 14 and 16 with respect to each other is known in the art. Similarly, the transmitter circuit 10 and the receiver circuit 12 are also well known. Accordingly, these features will not be described in detail. Located between the transmitter 10 and transmitting antenna 14 is a splitter network 20. Similarly, a combiner network 22 is located between the receiver 12 and the receiving antenna system 16. The networks 20 and 22 will be described more fully below.

As can be seen from FIG. 1, the transmitting antenna system 14 includes a plurality of coplanar loops 24, 26, 28 and 30 which preferably include conductive shields such as described in U.S. Pat. No. 4,251,808. Loops 24–30 lie successively along the vertical axis of the antenna. However, this is by way of example only as it is also possible to arrange the loops so as to be coplanar but along a horizontal axis. For reasons well known in the art, two of the loops are driven so as to be in phase opposition to the others.

Loop 24 of the transmitting antenna system 14 includes a pair of lead wires 32 which extend from the loop 24 to the splitter network 20 which is located at a position remote from the loop 24. Similarly, loops 26, 28 and 30 include pairs of lead wires 34, 36 and 38, respectively, which also extend to the splitter network 20. In a practical application of the transmitting antenna system 14, the loop 30 will be located physically closer to the splitter network 20 or other common point where the lead wires are interconnected. Thus, lead wires 32 are longer than lead wires 38 as will be described more fully hereinafter.

Although four planar loops 24, 26, 28 and 30 are shown as comprising the transmitting antenna 14, it should be readily apparent that any number of coplanar loops are possible. It is, of course, required however that if equal currents are used in each loop then the effective total loop area of the loops that are driven in one phase be equal to the effective total loop area of the loops driven in the opposite phase. While this can be accomplished simply by properly selecting the geometric sizes of the loops, the present invention permits the same also to be accomplished by properly driving each loop as will become more apparent hereinafter.

The foregoing description of the antenna system has made specific reference to the transmitting antenna system 14. It should be understood, however, that the receiving antenna system 16 including the coplanar loops 40, 42, 44 and 46 is constructed and arranged and functions in substantially the identical manner.

Figure 2:
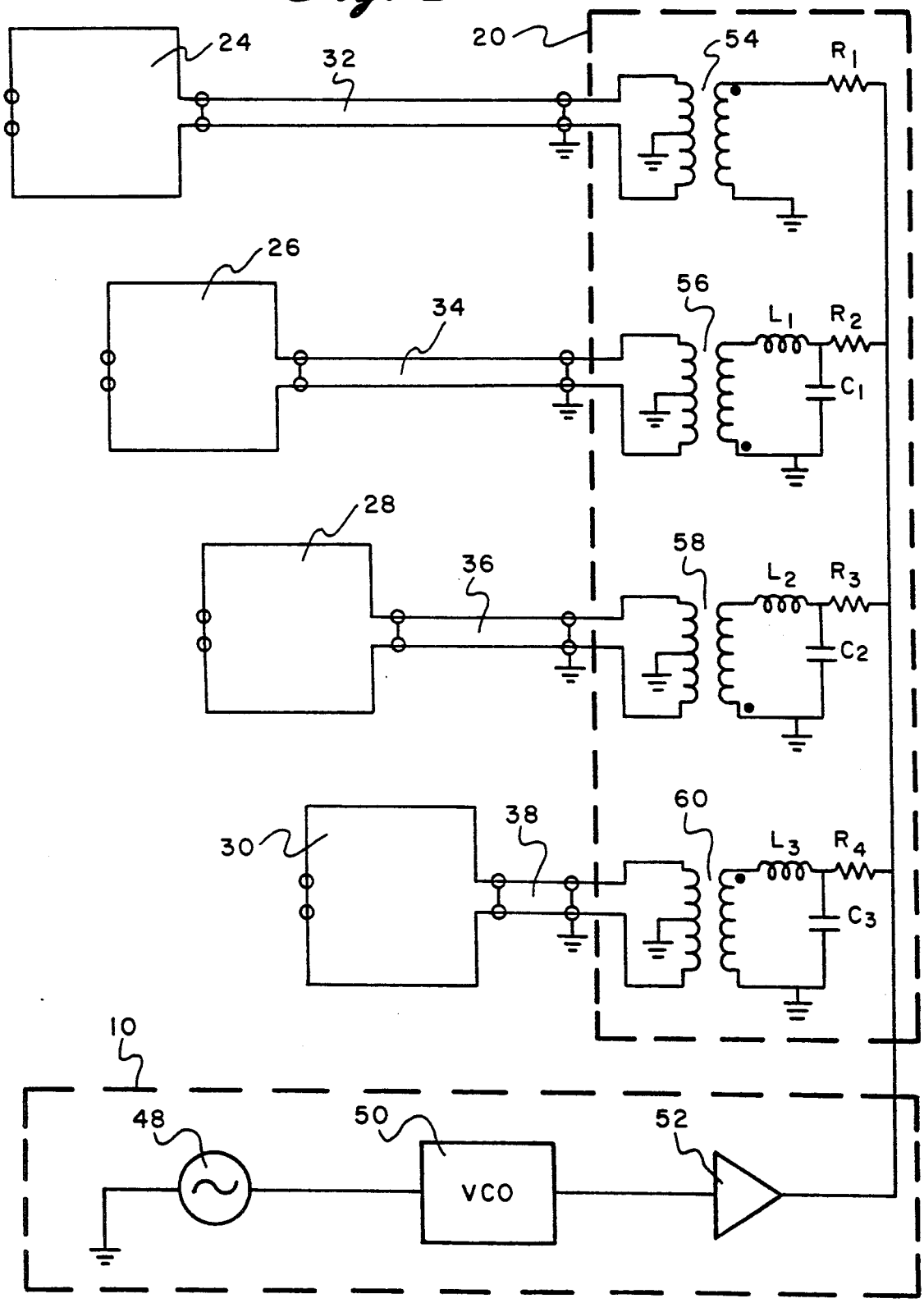
FIG. 2 is a schematic representation showing the transmitting antenna system of FIG. 1 in further detail.

Referring now to FIG. 2, there is shown a more detailed schematic representation of the transmitting system and antenna of the present invention. Transmitter 10 of FIG. 2 is comprised of a sweep signal generator 48, a voltage controlled oscillator 50 and an RF amplifier 52, all of which are well known in the art. It should be noted that while one RF amplifier 52 is shown it is possible to use a plurality of individual RF amplifiers, i.e. one for each of the antenna loops.

The antenna loops 24, 26, 28 and 30 of FIG. 2 are shown connected to the splitter network 20 through their respective pairs of lead wires 32, 34, 36 and 38. These lead wires 32–38 are comprised of shielded cables and as explained above, lead wires 32 are longer than lead wires 34 which, in turn, are longer than lead wires 36 and 38. That is, the lead wires are progressively shorter since the loops 24–30 are progressively closer to the splitter network 20.

Splitter network 20 is comprised of a plurality of toroid transformers 54, 56, 58 and 60. Each of the transformers has a primary to secondary winding ratio of 1:1 and includes a center tap on the secondary winding which is grounded. The secondary winding of transformer 54 is connected to the leads 32 of antenna loop 24. In a similar manner, transformers 56, 58 and 60 are connected to the loops 26, 28 and 30, respectively.

The primary winding of transformer 54 has one side thereof connected to ground and the other side connected to a voltage to current resistor R1 which, in turn, is connected to the output of the RF amplifier 52. While the primary winding of transformer 54 is connected directly to the RF amplifier through resistor R1, the primary windings of transformers 56, 58 and 60 include delay line circuits therein. The delay line circuit associated with transformer 56, for example, includes inductor L1 which is arranged in series with the primary winding and capacitor C1. The junction of L1 and C1 is connected to the RF amplifier 52 through resistor R2. Similarly, the primary winding circuit of transformer 58 includes inductor L2 and capacitor C2 connected to RF amplifier 52 through resistor R3 and transformer 60 includes inductor L3 and capacitor C3 connected to the amplifier through resistor R4.

As should be readily apparent to those skilled in the art, the delay line circuits are necessary in order to compensate for the differences in the lengths of the lead lines 32, 34, 36 and 38. Thus, the inductance of inductor L3 is selected so as to be equal to the inductance of the lead lines 32 minus the inductance of the lead lines 38. Similarly, the value of capacitor C3 is selected so as to be equal to the parasitic capacitance of the lead lines 32 minus the parasitic capacitance of the lead lines 38. The values of inductors L1 and L2 and capacitors Cl and C2 are similarly selected so as to compensate for the differences in the lengths of the lead lines. Furthermore, it should be readily apparent that while the delay line circuits are shown on the primary side of the transformer, they could be placed on the secondary side in order to accomplish the same result.

As pointed out above, the loops 24, 26, 28 and 30 are driven so that one-half the effective total loop area is in one phase and the other half is 180° out of phase therewith. This is easily accomplished by merely selecting the polarity of the transformers. Thus, in FIG. 2, it can be seen that transformers 54 and 60 are of the same polarity whereas transformers 56 and 58 are being driven in the reverse polarity.

Furthermore, since each of the loops 24, 26 28 and 30 are driven independently of the others, it is also possible to have loops of unequal areas and achieve far field cancellation by merely increasing or decreasing the current to one or more of the loops provided that the total current times loop area of one phase equals the total current times loop area of the opposite phase. This flexibility permits detection patterns to be optimized because of the independent and infinite adjustability of the current in each loop. Even further, flat frequency and matched linear phase characteristics in each loop can be achieved to minimize undesirable distortions in received marker signals resulting in improved immunity to false alarms and improved detection coverage.

Figure 3:
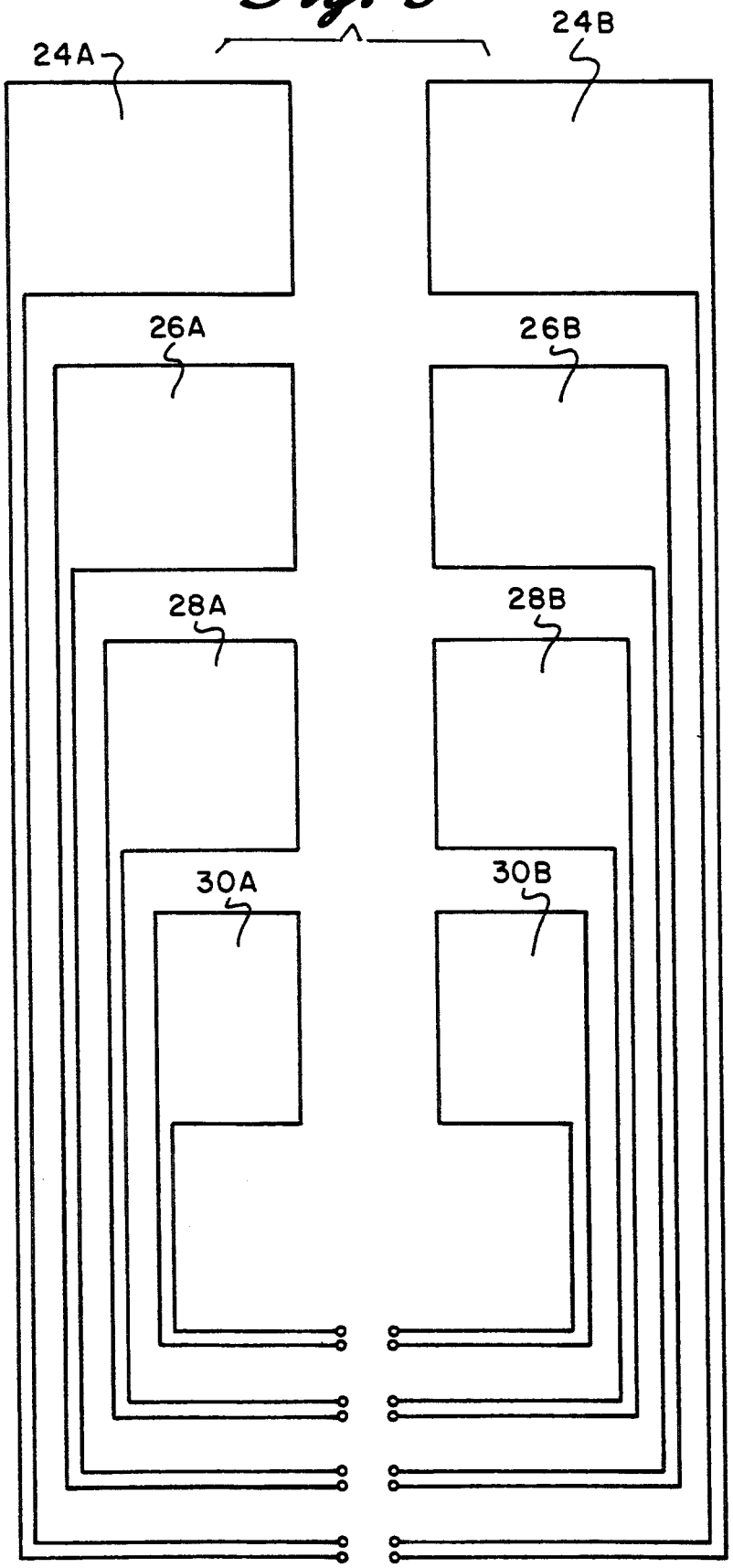
FIG. 3 is a schematic representation of a modified form of the antenna system of the present invention.

The present invention also eliminates high frequency limitations. This is accomplished by increasing the number of loops while making each loop smaller. Thus, as can be seen from FIG. 3, loops 24, 26, 28 and 30 can each be reduced to half their size and replaced by corresponding pairs of loops 24A and B, 26A and B, 28A and B and 30A and B. The combined loop of loop 24A and B would h=substantially equal to the area of loop A. Each of these subloops would be connected to a splitter network similar to that shown above so as to be driven independently of each other subloop.

While the foregoing description is primarily directed toward the transmitting antenna system, it should be readily apparent that it substantially applies also to the receiving antenna system as well. In the receiving system, however, it is preferred that the individual receive signals from the individual loop circuits be summed in series. These are then fed to an RF amplifier, a detector and a signal processor as is well known in the art.

The present invention may be embodied in other specific forms without departing from the spirit or essential attributes thereof and accordingly reference should be made to the appended claims rather than to the foregoing specification as indicating the scope of the invention.

I claim;

1. In an electronic security system for the detection of unauthorized removal of items containing a marker tag including a transmitter circuit, a receiver circuit, a transmitting antenna coupled to said transmitter circuit and a receiving antenna coupled to said receiver circuit and wherein said antennas are disposed in spaced parallel relationship with respect to each other and between which said items must pass for detection, the improvement wherein each of said antennas includes at least three coplanar loops lying successively along an antenna axis wherein each antenna includes two outer loops and at least one inner loop, each of said loops having a separate pair of lead wires extending to said transmitter circuit or said receiver circuit respectively, said circuits including a plurality of antenna transformer windings and each of said pairs of lead wires being connected to a different one of said windings, said loops being connected such that when said system is in operation, said outer loops of each antenna are of one phase and at least one inner loop is in phase opposition thereto.

2. The invention as claimed in claim 1 wherein each of said antennas includes two inner loops of the same phase.

3. The invention as claimed in claim 1 wherein the lead wires from at least one loop of said transmitting or receiving antenna is shorter than the lead wires of another of said loops and including a delay line circuit connected to said shorter leads.

4. The invention as claimed in claim 1 wherein each of said antennas has a combined effective loop area of one phase equal to a combined effective loop area of the opposite phase.

5. The invention as claimed in claim 1 wherein said transmitting antenna is driven such that the total current times loop area of one phase equals the total current times loop area of the opposite phase.

* * * * *